US005381638A

United States Patent [19]

Andersson

[11] Patent Number: 5,381,638

[45] Date of Patent: Jan. 17, 1995

[54] BUILDING STRUCTURE FORMED OF LIGHTWEIGHT INTERFITTING PANELS

[75] Inventor: Arne Andersson, Rastorp, Sweden

[73] Assignee: Arnes Plat AB, Orebro, Sweden

[21] Appl. No.: 90,035

[22] PCT Filed: Jan. 15, 1992

[86] PCT No.: PCT/SE92/00019

§ 371 Date: Jul. 20, 1993

§ 102(e) Date: Jul. 20, 1993

[87] PCT Pub. No.: WO92/13151

PCT Pub. Date: Aug. 6, 1992

[30] Foreign Application Priority Data

Jan. 22, 1991 [SE] Sweden ..... 9100188-3
Jun. 28, 1991 [SE] Sweden ..... 9102004-0

[51] Int. Cl.[6] ..... E04B 2/32

[52] U.S. Cl. ..... 52/592.1; 52/309.9; 52/468; 52/588.1; 52/589.1

[58] Field of Search ..... 52/233, 309.9, 468, 52/470, 471, 727, 91.1, 309.14, 469, 588.1, 589.1, 590.1, 590.2, 590.3, 592.1, 592.2, 592.4

[56] References Cited

U.S. PATENT DOCUMENTS

| | | | |
|---|---|---|---|
| 1,312,056 | 8/1919 | Shaw | 52/468 |
| 1,402,438 | 1/1922 | Nichols | 52/233 |
| 2,635,303 | 4/1953 | Poynter | 52/233 |
| 2,915,795 | 12/1959 | Kendall | 52/468 |
| 3,293,818 | 12/1966 | Gregoire | 52/468 |
| 3,381,428 | 5/1968 | Sillman | 52/233 |
| 3,440,784 | 4/1969 | Onjukka | 52/233 |
| 3,535,844 | 10/1970 | Glaros | 52/309.9 X |
| 3,744,826 | 7/1973 | Hawes | 52/309.9 X |
| 3,760,548 | 9/1973 | Sauer et al. | 52/592.1 |
| 4,100,710 | 7/1978 | Kowallik | 52/309.9 |
| 4,104,840 | 8/1978 | Heintz et al. | 52/309.9 |
| 4,140,824 | 2/1979 | Gaillard | 52/309.9 X |
| 4,143,498 | 3/1979 | Martin, Jr. et al. | 52/592.1 X |
| 4,177,615 | 12/1979 | Anderson | 52/309.9 X |
| 4,185,428 | 1/1980 | Boucquey et al. | 52/233 |
| 4,236,366 | 12/1980 | Rijnders | 52/592.1 X |
| 4,244,151 | 1/1981 | Seem | 52/309.9 X |
| 4,304,080 | 12/1981 | Freeman | 52/309.9 |
| 4,316,351 | 2/1982 | Ting | 52/309.9 |
| 4,559,274 | 12/1985 | Kloppe et al. | 52/309.9 X |
| 4,769,963 | 9/1988 | Meyerson | 52/309.9 |
| 4,907,383 | 3/1990 | Winter, IV | 52/309.9 X |
| 4,998,396 | 3/1991 | Palmersten | 52/588.1 |
| 5,092,095 | 3/1992 | Zadok et al. | 52/309.9 X |
| 5,138,812 | 8/1992 | Palmersten | 52/309.9 X |
| 5,293,728 | 3/1994 | Christopher et al. | 52/309.9 X |

FOREIGN PATENT DOCUMENTS

| | | | |
|---|---|---|---|
| 1434836 | 2/1969 | Germany | 52/592.1 |
| 2339335 | 2/1975 | Germany | 52/592.1 |
| 2445180 | 4/1976 | Germany | 52/309.9 |

*Primary Examiner*—Carl D. Friedman
*Assistant Examiner*—Kevin D. Wilkens
*Attorney, Agent, or Firm*—Dennison, Meserole, Pollack & Scheiner

[57] ABSTRACT

A building panel formed of two surface layers of metal or plastic spaced by an insulating core of polyurethane foam. Each panel has a male side edge and a female side edge which can be joined in side by side fashion to form an extended building structure. A cover strip can be installed between adjacent panels to mask the junction line between panels.

11 Claims, 7 Drawing Sheets

FIG. 5
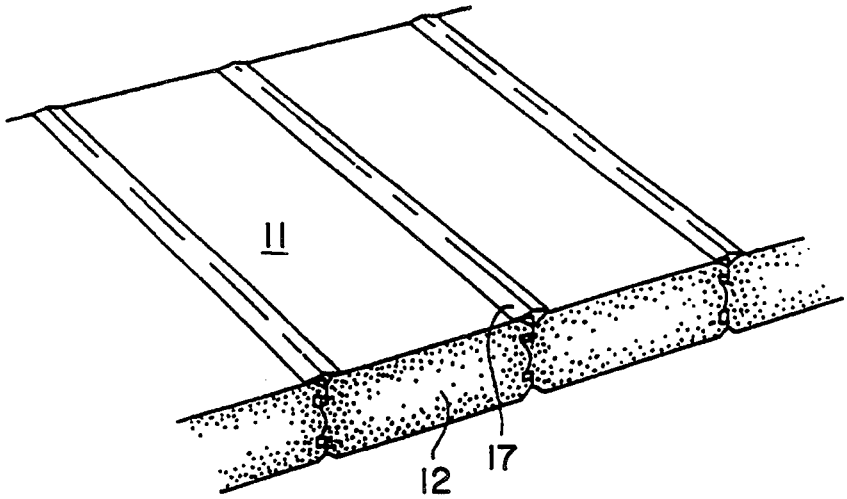
FIG. 6
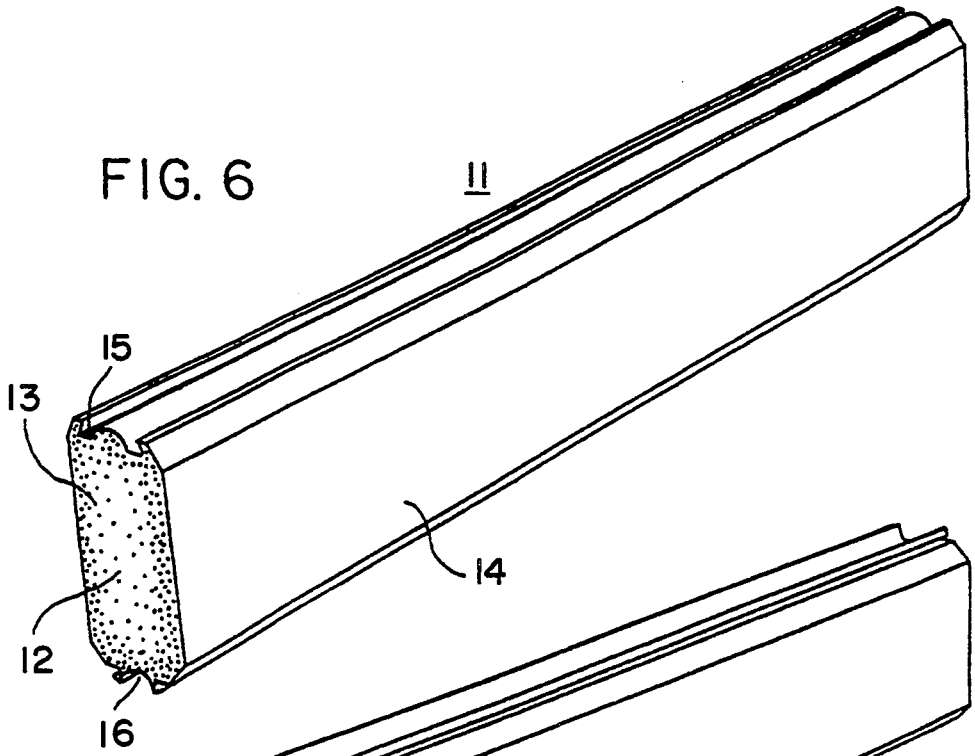
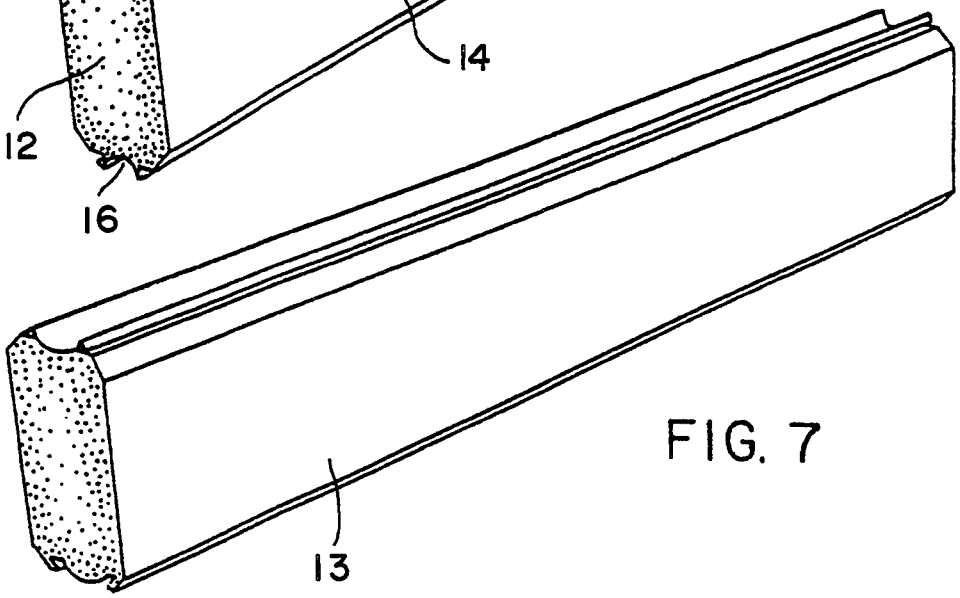
FIG. 7

BUILDING STRUCTURE FORMED OF LIGHTWEIGHT INTERFITTING PANELS

BACKGROUND OF THE INVENTION

The present invention relates to an elongated building element, preferably one having a tongue and groove. A conventional building element is of thick gauge mostly solid material and is thus too heavy, to be earned by one person alone. Such building elements are used for constructing outer and inner walls, roofs, and also floors. Grooves and tongues are arranged to cooperate to ensure a coherent surface when the elements are fitted together. It is also possible to build walls out of logs dovetailed at the corners, in which case each building element, besides having tongues and grooves, will be provided with a transverse recess with a width corresponding to the thickness of the element and a depth generally half the height of the element. Instead of tongues and grooves, a pole may be passed through building elements stacked one on top of the other in order to hold them together.

SUMMARY OF THE INVENTION

The object of the present invention is to produce a thick building element equivalent to the above but having the great advantage that the element can without difficulty be carried by one person because of its light weight. This is achieved according to the invention in that a core of plastic is used which has two opposite hard layers, suitably consisting of sheet metal, to which the plastic is adhered. The latter building element may also be provided with a tongue and groove, in which case said layers are shaped so that their extensions also cover the vertical walls of the tongue and groove.

A building element according to the present invention is most suitably manufactured by using a mould, said layers being placed on the inner sides of the mould. Once this has been done, the space between the two layers is filled with plastic in liquid form which is then allowed to solidify. A suitable liquid plastic is polyurethane which also has the ability to adhere to the inner surfaces of the layer.

Additional characteristics of the present invention are revealed in the appended claims.

BRIEF DESCRIPTION OF THE DRAWINGS

The present invention will be described in more detail with reference to the accompanying seven sheets of drawings in which;

FIG. 5 shows a surface unit comprising building elements of a first further development, FIGS. 6 and 7 show the further developed building element seen in perspective in two different directions.

Figure 1:
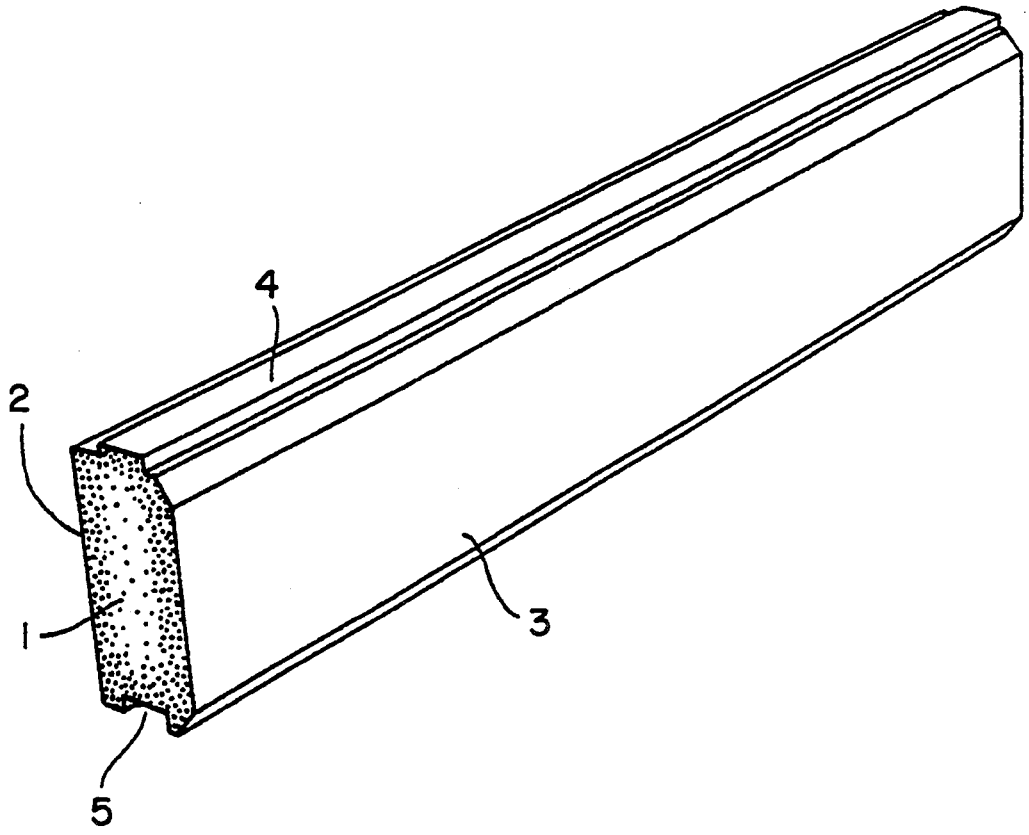
FIG. 1 shows a building element according to the present invention.

A building element is shown in FIG. 1 which has a plastic core 1 and two opposite layers 2 and 3, preferably of sheet metal. Said layers are also bent to form the vertical surfaces of a tongue 4 and groove 5. A building element according to FIG. 1 is suitably manufactured by placing the two layers 2 and 3, one in each side of a mould. The mould is then filled with liquid polyurethane foam which then solidifies, thus forming the building element shown in FIG. 1. Since the building element according to FIG. 3 has a plastic core, extremely thick units can be produced which, thanks to the plastic, are so light that they can be carried by one person. Since the building element is provided with a tongue and groove, a wall can easily be built by stacking a number of building elements one on top of the other. Thus building a sturdy wall, such as a partition in a living area, presents no great difficulty to a layman.

Figure 3:
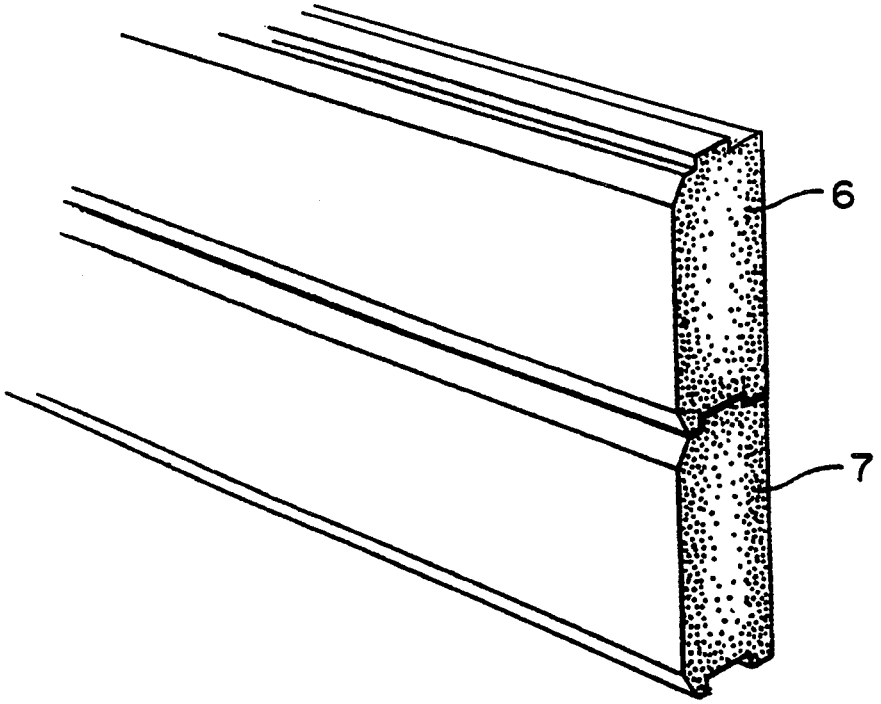
FIG. 3 shows a wall constructed out of two building elements.

FIG. 3 shows how two building elements 6 and 7 stack one above the other. If a building element is provided with a transverse recess 10 as wide as the width of a building element and as deep as up to half the height of a building element, a corner wall looking like the dovetailed corners of a log cabin can be produced with the aid of two beams 8 and 9 as shown in FIG. 4.

Figure 2:
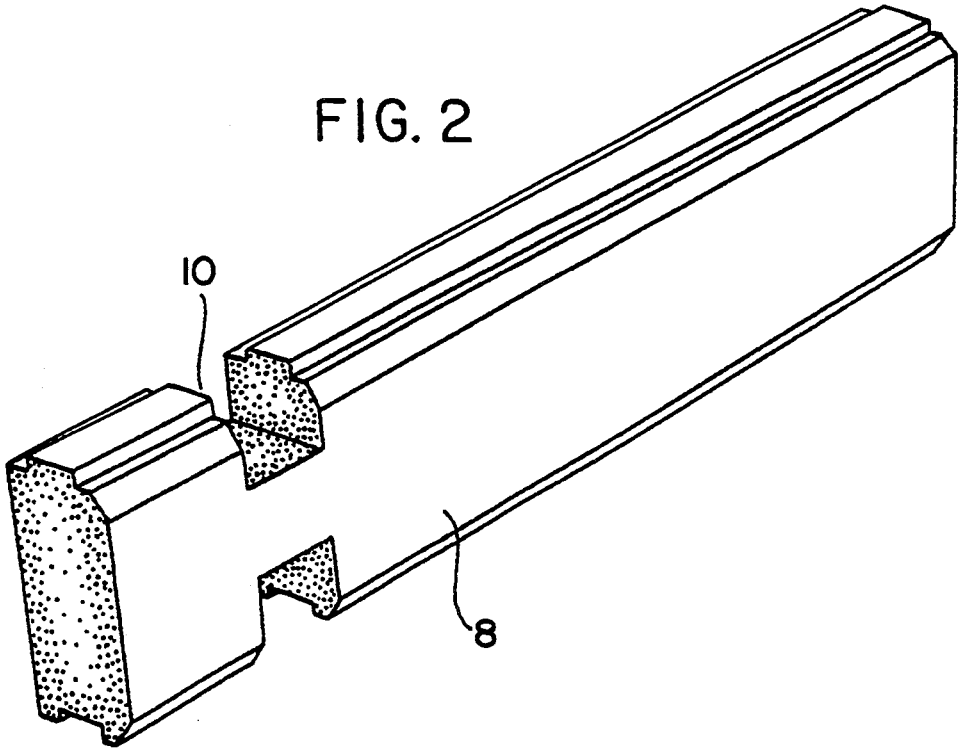
FIG. 2 shows the same building element as FIG. 1 but with two recesses.
Figure 4:
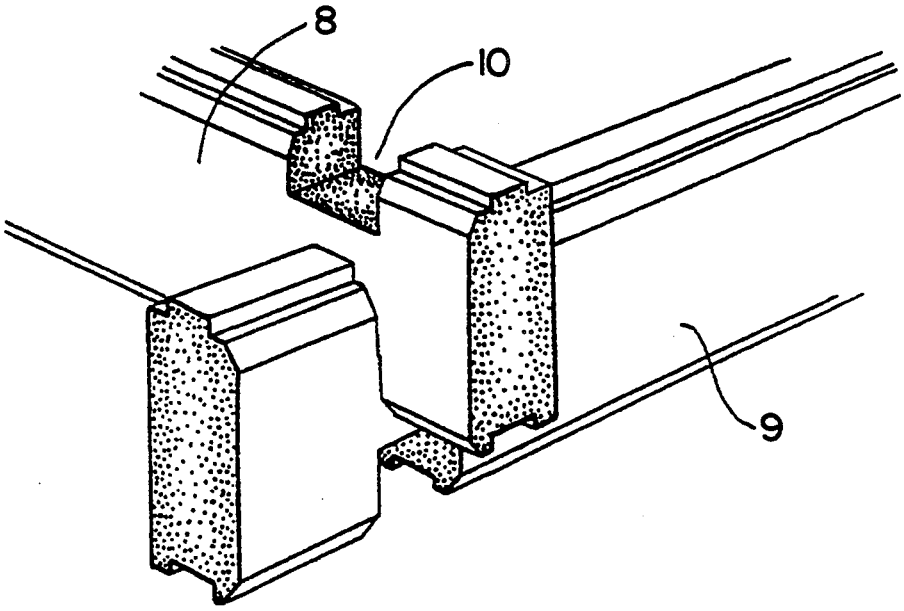
FIG. 4 shows how a corner is formed with the aid of building elements.

FIG. 2 shows a building element 8 for inclusion in a corner wall according to FIG. 4. The building element 8 is identical to the element shown in FIG. 1 with the exception of the recess.

Figure 8:
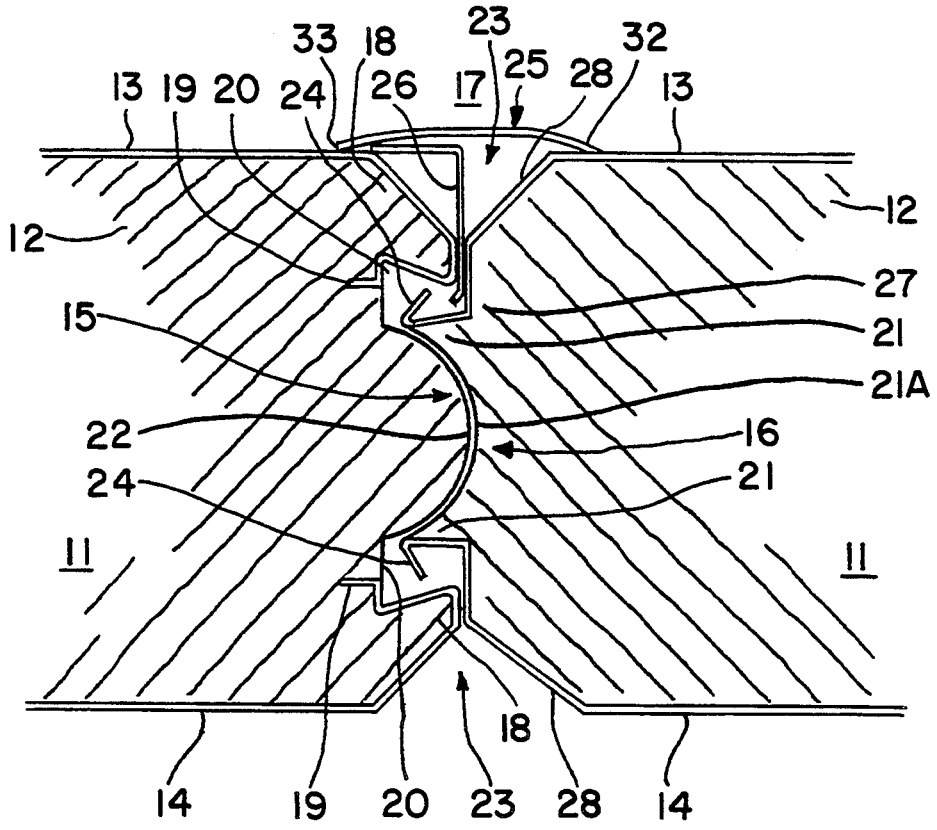
FIG. 8 shows how the building elements are combined together.

The surface unit according to FIG. 5 is composed of building elements as shown in FIGS. 6 and 7. The building element 11 has a plastic core 12 and two hard layers 13 and 14. The building element is provided with a tongue 15 and a groove 16. FIG. 8 is an enlarged view showing how groove 16 of the female side edge of a building elements is joined with the tongue 15 on the male side edge of a similar building element. Core 12 on the right building element is provided with a rounded groove 21A flanked by two pointed projections 21. Hard layers 13 and 14 extend into the female side edge at angled portions 28 and cover the pointed projections 21 terminating in a reversely bent lip 24.

Core 12 on the left building element is provided with a rounded tongue 22 flanked by a pair of angled extensions 18 spaced from tongue 22 to form recesses 20. Hard layers 13 and 14 extend into the male side edge to cover angled extensions 18 and to terminate at end portions 19 embedded in core 12. The extensions 18 and the angled portion 28 form V-shaped grooves 23 on opposite sides of the building elements.

As seen in FIG. 8 where two building elements are joined, the rounded tongue 22 seats in rounded groove 21A to center the elements. Projections 21 enter recesses 20. Reversely bent lip 24 forms a channel which permits drainage of moisture.

Figure 13:
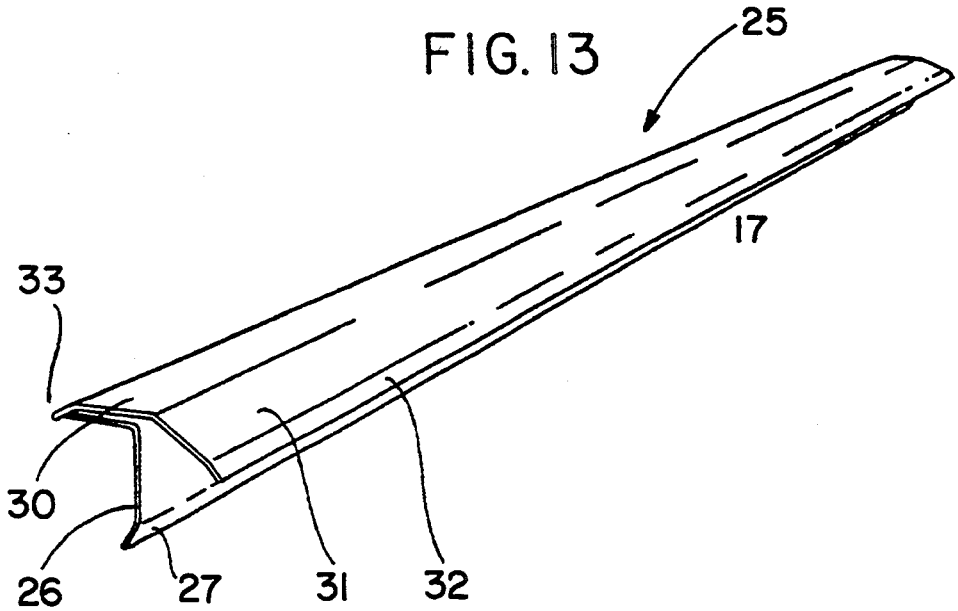
FIG. 13 shows a covering strip used in all surface units.

A cover unit 17 can be applied to the outside surface of the building element to cover exposed groove 23. As shown in FIG. 13, a metal strip 25 is formed with two slightly angled sections 30, 31 terminated in bent edges 32, 33. A stem 26 depends from a medial portion of the cover unit and is terminated in a securing tab 27. As can be seen in FIG. 8, the stem 26 is inserted between the building elements until tab 27 enters recess 20 while bent edges 32, 33 contact hard layer 13.

Figure 10:
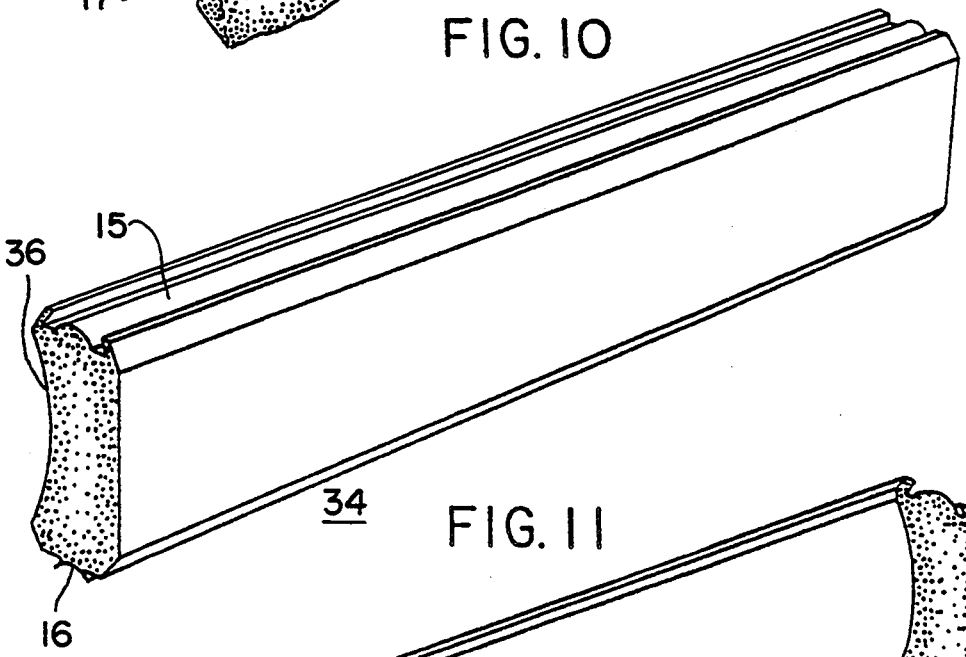
FIGS. 10 and 11 show the building element used in FIG. 9, from two different directions.
Figure 11:
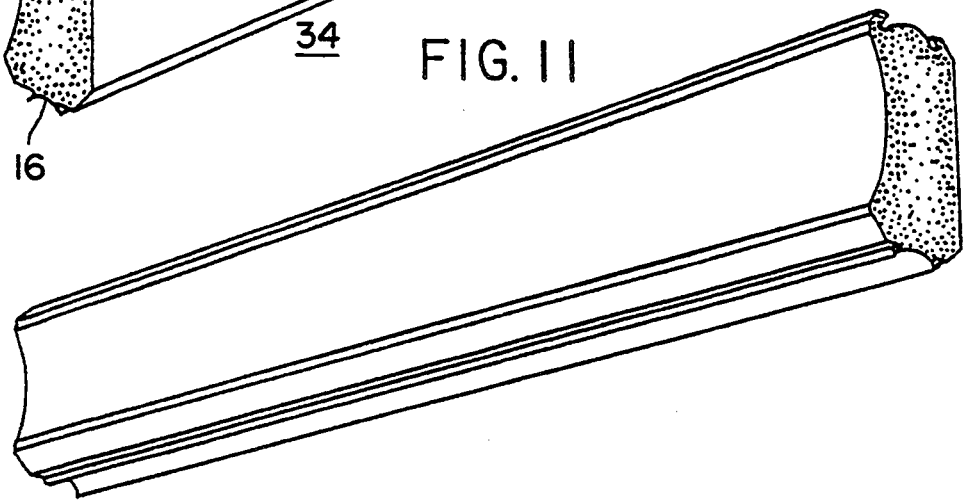

FIG. 10 shows a second embodiment of a building element with core of plastic and two hard layers 35 and 36 forming the exterior surfaces of the building element. The building element has a groove 16 and a tongue 15 and is designated 34. FIG. 10 shows clearly that the exterior surface 36 is curved inwardly, the outer surface thus forming a channel which runs from right to left.

Figure 9:
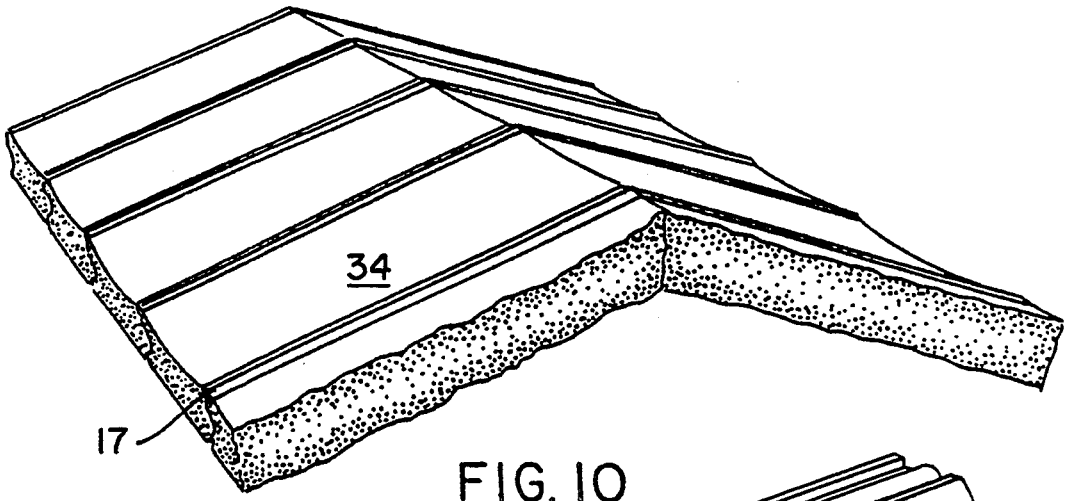
FIG. 9 shows a surface element with a second further development of the building element.

FIG. 9 shows a roof assembled from building elements like those shown in FIG. 10 but with the curved surface facing upwards. A covering strip 17 of the type shown in FIG. 13 is shown. Arranging building elements in this manner provides natural flow channels for rain falling on the roof.

Figure 12:
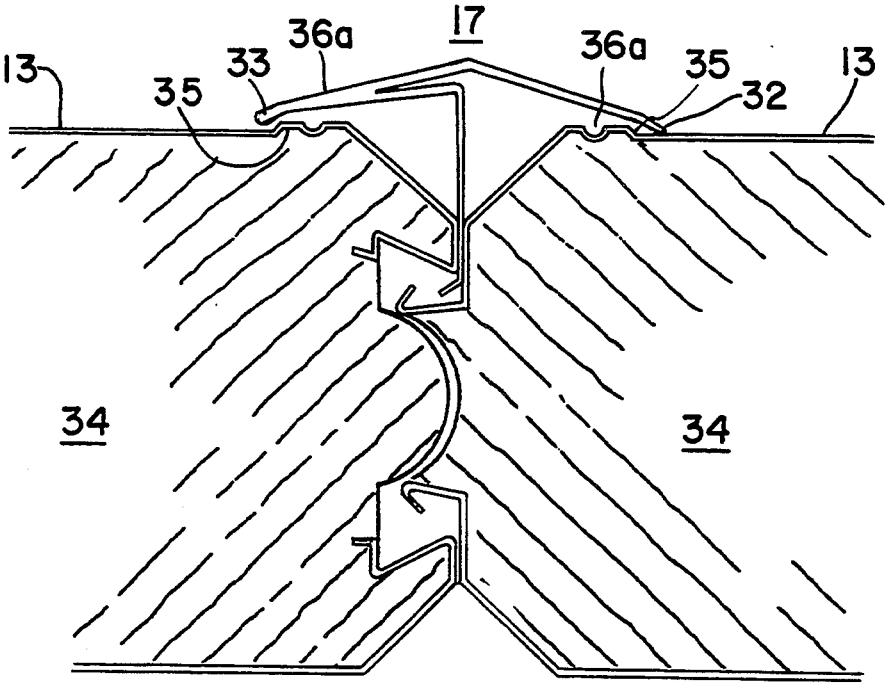
FIG. 12 shows how the building elements according to FIG. 9 are combined.

FIG. 12 shows how two building elements 34 are joined. The method of joining the building elements 34 is identical to that shown in FIG. 8 and the description is not repeated here. The only differences between the FIGS. 8 and 12 constructions are in the provision of moisture drainage channels **36*a* and raised portions 35. The channels 36*a* carry off any moisture which gets under cover 12 while the tabs 32, 33 engage the upraised portions 35 to effect a better seal between the cover 17 and hard layers 13**.

Figure 14:
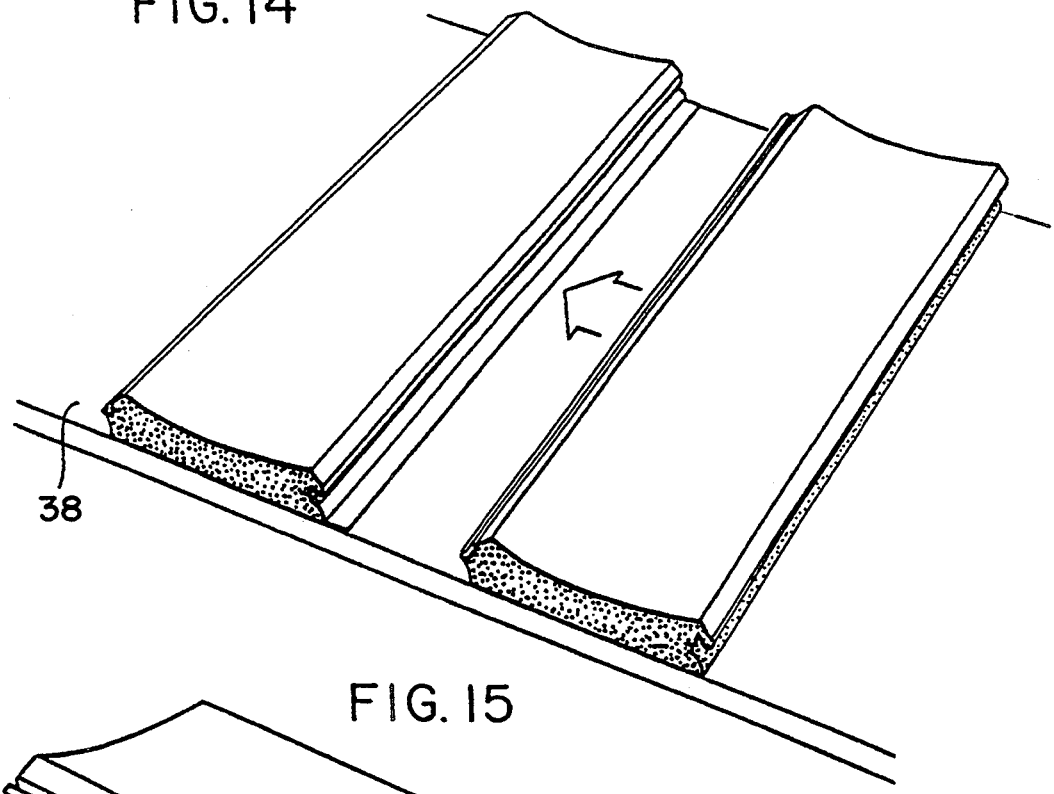
FIG. 14 shows a surface unit under construction, using building elements according to a third further development.
Figure 15:
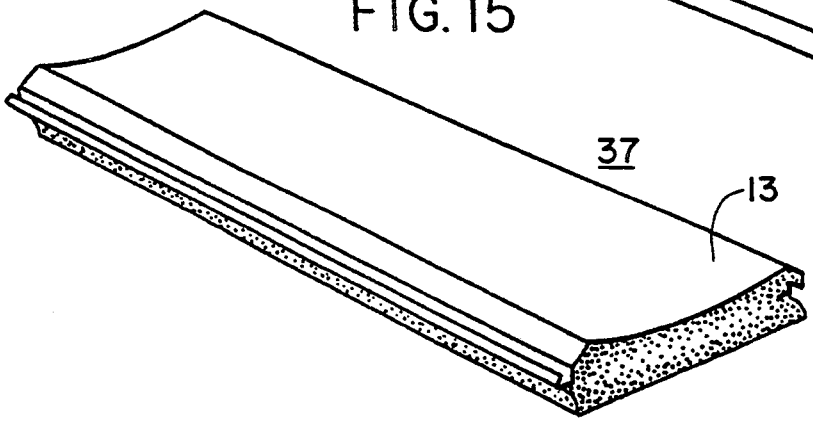
FIG. 15 shows the surface element used in FIG. 14.

FIG. 15 shows building elements 37 obtained by dividing the building element 34 in two halves along a medial plane. The upper half of the building element with hard layer 13 on the top surface is shown in FIG. 15. The bottom surface has no hard layer and the exposed core is seated directly on the roofing felt 38. The building element is designed to be placed on top of a roof covered with roofing felt. The remaining groove and tongue parts cooperate in the same way as before and the curved surface faces upwards so that the roof covered with roofing felt has the same appearance as in FIG. 9 where a number of parallel channels are formed for rain water to run off. An example of such a roof covered with felt is shown in FIG. 14, the roofing felt being designated 38.

Figure 16:
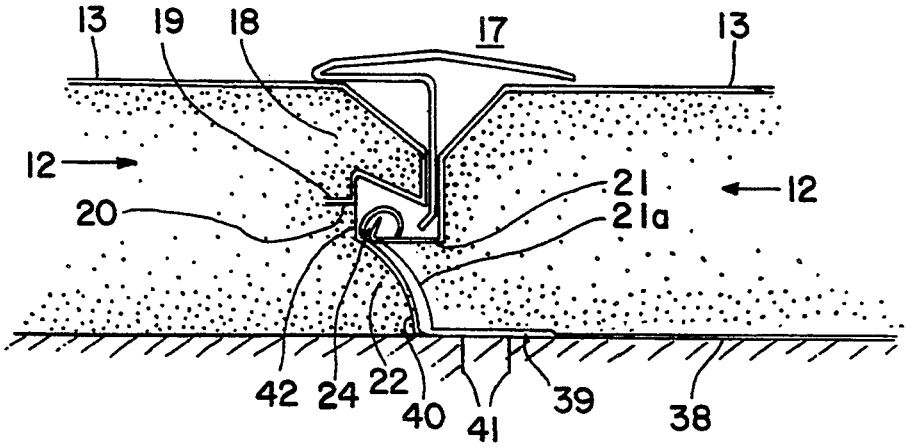
FIG. 16 shows how two surface elements as shown in FIG. 15 are joined together.

FIG. 16 shows how two building elements 37 are joined and it will immediately be noted that the joint agrees with that in a half section of FIG. 8 and that the covering strip 17 is identical to that used in FIG. 8. A unit 39 nailed into the roofing felt 38 is used to anchor the building elements to the roofing felt 38. The nailing unit 39 has a rounded portion overlying the tongue 22 and terminated in a resilient hook 42 situated at the same level as lip 24. The nailing unit is secured to the roofing felt and roof support by means of roofing nails 41. When the building element on the right in FIG. 16 is placed in abutting relationship with the left building element, lip 24 snaps into resilient hook 42 to prevent its separation.

I claim:

1. An elongated building panel (11) formed of first (13) and second (14) spaced hard layers forming first and second walls, respectively, an insulating plastic material (12) filling the space between said first and second layers and bonded thereto to form said elongated building panel, said elongated building panel having elongated coextensive male (15) and female (16) side edges, said female side edge comprising a rounded groove **(21*a*) flanked by a pair of pointed projections (21) formed in said plastic material, said first and second hard layers extending into said elongated female side edge to cover said pointed projections and terminate at free end lip portions (24), and said male elongated side edge comprising a rounded tongue (22) flanked by a pair of extensions (18) spaced from said tongue thereby forming recesses (20), said extensions being angled in the direction of the center of the elongated building panel, said first and second hard layers extending into said elongated male side edge to cover said angled extensions and to terminate in end portions (19)** in said plastic core.

2. The building panel according to claim 1 wherein said female side edge has its respective corners (28) angled, said angle being similar to the angle of said angled extensions ( 18 ) in said male side edge.

3. An elongated building panel as claimed in claim 2 joined with a similar building panel in a side by side manner with the male side edge abutting the female side edge whereby said rounded tongue (22) seats in said rounded groove **(21*a*), said projections (21) being received in said recesses (20), and said angled extensions and said angled corners forming opposed V-shaped grooves (23)**.

4. The combination of claim 3 wherein an elongated cover member (17) is formed of a metal strip (25) having a flange comprising two slightly angled similar sections (30, 31) terminating in bent edges (32, 33), a stem (26) depending from a medial portion of said flange, said stem terminating in a securing tab (27) whereby when said stem and securing tab is inserted between two abutting building panels, said flange covers a V-shaped groove (23).

5. The combination of claim 3 including a plurality of building panels assembled in side by side manner to form a roof structure, the exposed wall (36) of each panel being concave in shape to form a main drainage channel.

6. The combination of claim 3 wherein the exposed concave wall (36) of each abutting panel (34) being provided with an upraised portion (35) and a secondary drainage channel **(36*a*) adjacent the V-shaped groove (23)**.

7. The combination of claim 3 wherein a cover strip (17) is supported by said abutting panels to overlie said V-shaped groove and said secondary drainage channel **(36*a*) and to contact said upraised portion (35)**.

8. The building panel according to claim 1 wherein each of said free end lip portions (24) is outwardly turned to form with its associated hard layer a channel to drain moisture.

9. The building panel of claim 1 wherein said hard layers are formed of sheet metal and said plastic material comprises polyurethane foam.

10. An elongated roofing panel for attachment to a wood and felt roofing support surface, said roofing panel formed of a single hard layer (13) concave in shape facing away from said support surface, an insulating plastic backing bonded to said concave hard layer, said elongated roofing panel having elongated coextensive male and female side edges, said female side edge comprising a rounded groove **(21*a*) flanked by a pointed projection (21) formed in said plastic material, said hard layer extending into said elongated female side edge to cover said pointed projection and terminate at a free end lip portion (24), said male elongated side edge comprising a rounded tongue (22) flanked by an extension (18) spaced from said tongue forming a recess (20), said extension being angled in the direction away from said concave surface, said hard layer extending into said elongated male side edge to cover said angled extension and to terminate in an end portion (19) in said plastic backing, a nailing strip (39) nailed to said roofing support surface and having a rounded portion (40) on said rounded tongue (22) and terminating in a resilient hook (42) located in said recess (20) whereby when a similar roofing panel is joined in a side by side manner with the male side edge abutting the female side edge, said rounded tongue and said rounded portion of said nailing strip seat in said rounded groove, and said free-end lip portion (24**) snaps into said resilient hook to join the roofing panels.

11. The combination of claim 10 wherein the female side edge at the corner spaced from the support surface is angled to form a V-shaped notch in association with said angled extension, said V-shaped notch being covered by a cover strip (17) supported by said abutting surface panels.

* * * * *